US009255762B2

(12) United States Patent
Kelly et al.

(10) Patent No.: US 9,255,762 B2
(45) Date of Patent: Feb. 9, 2016

(54) ARCHERY RELEASE COMPRISING FINGER EXTENSION

(71) Applicant: Perfect Form Manufacturing LLC, Wilmington, DE (US)

(72) Inventors: Daniel N. Kelly, Rochester, NY (US); Eric J. Griggs, Stanton, KY (US)

(73) Assignee: Perfect Form Manufacturing LLC, Wilmington, DE (US)

( * ) Notice: Subject to any disclaimer, the term of this patent is extended or adjusted under 35 U.S.C. 154(b) by 0 days.

(21) Appl. No.: 14/500,337

(22) Filed: Sep. 29, 2014

(65) Prior Publication Data

US 2015/0090241 A1 Apr. 2, 2015

Related U.S. Application Data

(60) Provisional application No. 61/883,422, filed on Sep. 27, 2013, provisional application No. 61/884,493, filed on Sep. 30, 2013.

(51) Int. Cl.
*F41B 5/18* (2006.01)
*F41B 5/14* (2006.01)

(52) U.S. Cl.
CPC ..... *F41B 5/1469* (2013.01)

(58) Field of Classification Search
CPC ..... F41B 5/1469
USPC ..... 124/35.2
See application file for complete search history.

(56) References Cited

U.S. PATENT DOCUMENTS

| | | | | | |
|---|---|---|---|---|---|
| 228,302 | A | | 6/1880 | Beard | |
| 229,089 | A | | 6/1880 | Burnham | |
| 2,133,650 | A | * | 10/1938 | Baker | 124/35.2 |
| 3,768,456 | A | * | 10/1973 | Hansen et al. | 124/35.2 |
| 3,853,111 | A | * | 12/1974 | Stanislawski et al. | 124/35.2 |
| 3,965,884 | A | * | 6/1976 | Killian | 124/35.2 |
| 4,036,204 | A | | 7/1977 | Scott | |
| 4,041,926 | A | | 8/1977 | Troncoso, Jr. | |
| 4,160,437 | A | | 7/1979 | Fletcher | |
| 4,424,791 | A | * | 1/1984 | Muehleisen | 124/35.2 |
| 4,509,497 | A | | 4/1985 | Garvison | |
| 4,539,968 | A | | 9/1985 | Garvison | |
| 4,567,875 | A | | 2/1986 | Fletcher | |
| 4,574,767 | A | | 3/1986 | Gazzara | |
| 4,612,907 | A | * | 9/1986 | Gantt | 124/35.2 |
| 4,620,523 | A | | 11/1986 | Peck | |
| 4,674,469 | A | | 6/1987 | Peck | |

(Continued)

OTHER PUBLICATIONS

Various prior art releases (1) downloaded from http://www.archeryhistory.com/releases/releasespics/pse.jpg, Dec. 2009.

(Continued)

*Primary Examiner* — Alexander Niconovich
(74) *Attorney, Agent, or Firm* — Barclay Damon, LLP

(57) ABSTRACT

A triggerless back tension archery release is provided. Disclosed archery releases include a bearing ring that rotates relative to a release body. During use, the bearing ring rotates to the same position when force is applied during a draw cycle. This reduces inconsistent placement of the finger and provides consistent release alignment. Disclosed archery releases also include a variety of removable finger extension that provide high mass triggers. An archer can feel subtle movement of the high mass triggers with increased accuracy which provides better control over the archery release.

20 Claims, 10 Drawing Sheets

(56) References Cited

U.S. PATENT DOCUMENTS

| | | | | |
|---|---|---|---|---|
| 4,854,293 | A | 8/1989 | Roberts | |
| 4,881,516 | A | 11/1989 | Peck | |
| 5,009,214 | A | 4/1991 | Wilde | |
| 5,025,772 | A | 6/1991 | Stevenson | |
| 5,205,268 | A | 4/1993 | Savage | |
| 5,261,581 | A | 11/1993 | Harden, Sr. | |
| 5,273,021 | A | 12/1993 | Tepper | |
| 5,323,754 | A | 6/1994 | Pittman | |
| 5,448,983 | A | 9/1995 | Scott | |
| 5,546,924 | A | 8/1996 | Todd | |
| 5,595,167 | A | 1/1997 | Scott | |
| 5,596,977 | A | 1/1997 | Scott | |
| 5,685,286 | A | 11/1997 | Summers | |
| 5,692,490 | A * | 12/1997 | Walker | 124/35.2 |
| 5,694,915 | A * | 12/1997 | Summers | 124/35.2 |
| 5,765,536 | A | 6/1998 | Scott | |
| 5,803,068 | A | 9/1998 | Summers | |
| 5,850,825 | A | 12/1998 | Scott | |
| 5,937,842 | A | 8/1999 | Summers | |
| 6,032,661 | A | 3/2000 | Goff | |
| 6,302,093 | B1 * | 10/2001 | Holland | 124/35.2 |
| 6,571,786 | B2 * | 6/2003 | Summers et al. | 124/35.2 |
| 6,631,709 | B2 * | 10/2003 | Carter et al. | 124/35.2 |
| 6,647,976 | B2 * | 11/2003 | Summers et al. | 124/35.2 |
| 6,712,060 | B2 * | 3/2004 | Egusquiza | 124/91 |
| 6,736,124 | B2 * | 5/2004 | Carter | 124/35.2 |
| 6,895,951 | B2 * | 5/2005 | Summers et al. | 124/35.2 |
| 6,945,241 | B2 | 9/2005 | Pellerite | |
| 6,953,035 | B1 | 10/2005 | Summers | |
| D597,164 | S * | 7/2009 | Jones | D22/107 |
| 7,654,254 | B1 | 2/2010 | Rentz | |
| 8,622,051 | B2 | 1/2014 | Summers | |
| 8,746,221 | B2 * | 6/2014 | Rentz | 124/35.2 |
| 2003/0159682 | A1 * | 8/2003 | Pellerite | 124/35.2 |
| 2004/0079351 | A1 | 4/2004 | Summers | |
| 2008/0149084 | A1 * | 6/2008 | Whalen et al. | 124/35.2 |
| 2009/0056689 | A1 * | 3/2009 | Jones | 124/35.2 |
| 2009/0090342 | A1 | 4/2009 | Freitag | |
| 2009/0095270 | A1 | 4/2009 | Graves | |
| 2010/0108047 | A1 | 5/2010 | Jones | |
| 2011/0168146 | A1 | 7/2011 | Deceuster | |
| 2012/0192844 | A1 | 8/2012 | Springer | |
| 2012/0285431 | A1 * | 11/2012 | Summers et al. | 124/35.2 |
| 2013/0025578 | A1 | 1/2013 | Jones | |
| 2013/0092140 | A1 * | 4/2013 | Rentz | 124/35.2 |

OTHER PUBLICATIONS

Various prior art releases (1) downloaded from http://www.archeryhistory.com/releases/releasespics/release4.jpg, Dec. 2009.
Prior art releases (3) downloaded from http://wwww.archeryhistory.com/releases on Jul. 21, 2011.
Prior art releases (4) downloaded from http://www.archeryhistory.com/releases on Jul. 21, 2011.
Longhorn Hunter (Jan. 2010).

* cited by examiner

ARCHERY RELEASE COMPRISING FINGER EXTENSION

CROSS-REFERENCE TO RELATED APPLICATIONS

This application is a non-provisional of U.S. patent application Ser. No. 61/883,422 (filed Sep. 27, 2013) and U.S. patent application Ser. No. 61/884,493 (filed Sep. 30, 2013) the entirety of which are incorporated by reference.

BACKGROUND OF THE INVENTION

The subject matter disclosed herein relates to archery releases and to triggerless back tension releases in particular.

Archery releases are designed to hold a bowstring so that an archer can pull on the release and draw the bowstring with the release. Archery releases assist the archer in cleanly and consistently releasing the bowstring when the archer shoots an arrow from the bow. This increases the accuracy of the archer's shot.

There are a variety of archery releases available including trigger releases and back tension releases. A trigger release typically includes a trigger mechanism and one or more moveable jaws joined with the trigger mechanism. The moveable jaws are configured to hold a bowstring of a bow. When activated by the archer's finger, the trigger mechanism moves the moveable jaws to release the bowstring. A back tension release typically includes a release handle, a release head bracket pivotally secured to the handle, and a hook pivotally secured to the release head bracket. The hook is configured to hold the bowstring, and is also adapted to engage a pawl. To operate the release so that it releases a bowstring held in the hook, an archer holds the handle, and squeezes the archer's shoulder blades together or, in other words, "tense their back." Because the archer holds the device in their hand by the handle, tensing of the back muscles moves the hand and, in turn, rotates the release slightly. This slight rotation moves the release enough so that the hook disengages the pawl, and thereby becomes free to move and release the bowstring. The discussion above is merely provided for general background information and is not intended to be used as an aid in determining the scope of the claimed subject matter.

BRIEF DESCRIPTION OF THE INVENTION

A triggerless back tension archery release is provided. Disclosed archery releases include a bearing ring that rotates relative to a release body. During use, the bearing ring rotates to the same position when force is applied during a draw cycle. This reduces inconsistent placement of the finger and provides consistent release alignment. Disclosed archery releases also include a variety of removable finger extension that provide high mass triggers. An archer can feel subtle movement of the high mass triggers with increased accuracy which provides better control over the archery release.

An advantage that may be realized in the practice of some disclosed embodiments of the back tension archery release is that an archer can feel the subtle movements of a high mass trigger and this provides increased control.

In a first embodiment, a triggerless back tension archery release is provided. The release comprises a release body, a finger extension removably connected to the release body, and a triggerless hook assembly connected to the release body. The triggerless hook assembly is configured to selectively release a bowstring upon actuation of the finger extension. The release has a total weight and at least 50% of the total weight is in the finger extension.

In a second embodiment, a triggerless back tension archery release is provided. The release comprises a release body, a finger extension removably connected to the release body, the finger extension consisting essentially of stainless steel, aluminum or brass. A triggerless hook assembly is connected to the release body and is configured to selectively release a bowstring upon actuation of the finger extension. The release has a total weight and at least 50% of the total weight is in the finger extension.

In a third embodiment, a kit is provided. The kit comprises a three-finger extension configured to connect to a recess within a release body and a four-finger extension configured to connect to the recess within the release body. The kit further comprises a triggerless back tension archery release comprising the release body with the recess, wherein the recess is configured to connect to a finger extension selected from the group consisting of the three-finger extension and the four-finger extension. The release comprises a triggerless hook assembly connected to the release body that is configured to selectively release a bowstring upon actuation of the finger extension. The release has a total weight and at least 50% of the total weight is in the finger extension.

This brief description of the invention is intended only to provide a brief overview of subject matter disclosed herein according to one or more illustrative embodiments, and does not serve as a guide to interpreting the claims or to define or limit the scope of the invention, which is defined only by the appended claims. This brief description is provided to introduce an illustrative selection of concepts in a simplified form that are further described below in the detailed description. This brief description is not intended to identify key features or essential features of the claimed subject matter, nor is it intended to be used as an aid in determining the scope of the claimed subject matter. The claimed subject matter is not limited to implementations that solve any or all disadvantages noted in the background.

BRIEF DESCRIPTION OF THE DRAWINGS

So that the manner in which the features of the invention can be understood, a detailed description of the invention may be had by reference to certain embodiments, some of which are illustrated in the accompanying drawings. It is to be noted, however, that the drawings illustrate only certain embodiments of this invention and are therefore not to be considered limiting of its scope, for the scope of the invention encompasses other equally effective embodiments. The drawings are not necessarily to scale, emphasis generally being placed upon illustrating the features of certain embodiments of the invention. In the drawings, like numerals are used to indicate like parts throughout the various views. Thus, for further understanding of the invention, reference can be made to the following detailed description, read in connection with the drawings in which.

DETAILED DESCRIPTION OF THE INVENTION

Figure 1:
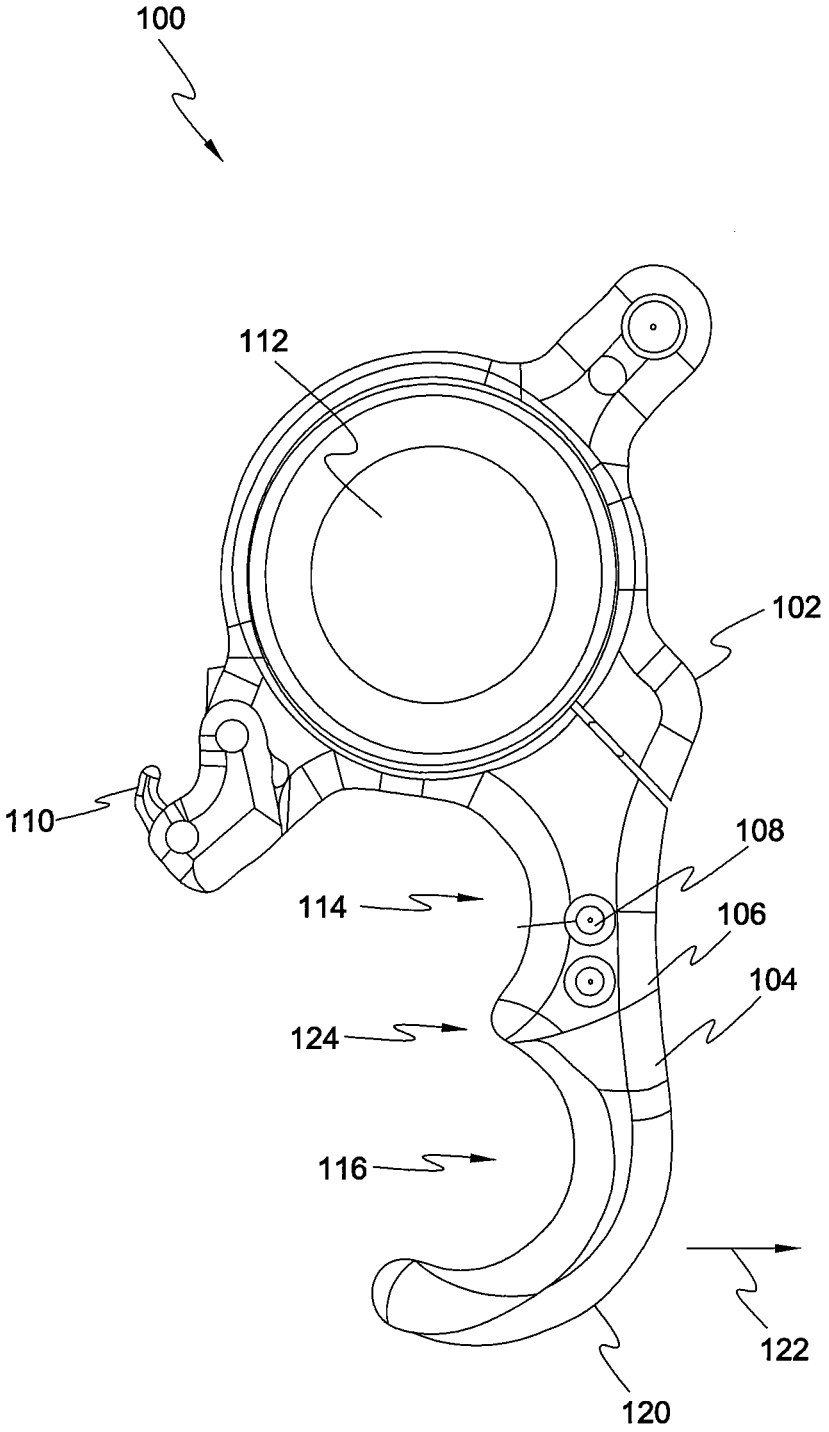
FIG. 1 depicts an exemplary release with a three-finger extension.

FIG. 1 depicts an exemplary release 100 for use in archery. The release 100 includes a release body 102 and a three-finger extension 104. The release 100 is a triggerless back-tension release. The three-finger extension 104 is attached to the release body 102 at junction 106. A protrusion in the three-finger extension 104 fits into a recess in the release body 102 and is securely mounted therein by at least one bolt 108. In one embodiment, the bolt 108 is a hex-bolt or other suitable means for securing. The bolt 108 is removable such that the three-finger extension 104 can be withdrawn from the recess and replaced with a different finger extension.

In use, an archer places a bowstring of a bow within a bearing hook 110. In the embodiment of FIG. 1, the three-finger extension 104 permits the release 100 to be used as a three-finger release. An index finger is placed in a first finger position 112, a middle finger is placed in a second finger position 114 and a ring finger is placed in a third finger position 116. A crest 124 is provided to separate the first finger position 112 from the second finger position 114. In a back tension release, the release is actuated to release the bowstring by moving a distal end of the finger extension in a backward direction. The archer performs this actuation by tensioning his or her back while minimizing any movement of the release 100 that may negatively effect the release of the bowstring. For example, in the embodiment of FIG. 1, an archer moves a distal end 120 of the three-finger extension 104 in a backward direction 122 to trigger release of the bowstring.

Figure 2:
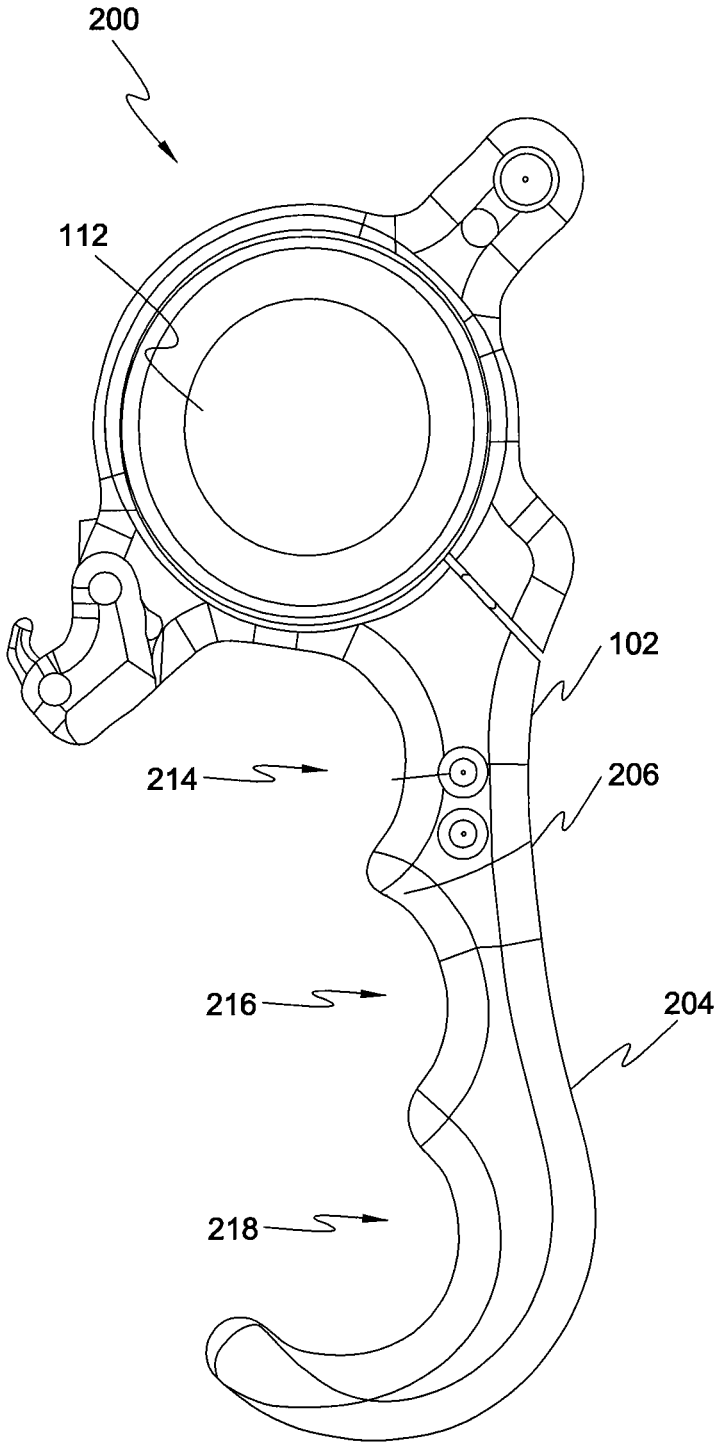
FIG. 2 depicts an exemplary release with a four-finger extension.

FIG. 2 depicts another release 200 that attaches the release body 102 to a four-finger extension 204 at a junction 206. An index finger is placed in the first finger position 112, a middle finger is placed in a second finger position 214, a ring finger is placed in a third finger position 216 and the small finger is placed in a fourth finger position 218.

Some archers prefer to use a particular number of fingers when using a release. Examples of such preferences include two-finger releases, three-finger releases and four-finger releases. Other archers prefer the reverse. The removable finger extensions 104, 204 permit archers the option of connecting a preferred finger extension to a common release body 102.

The finger extensions are weighted to provide better control in the shooting of the release. In one embodiment, at least about 50% of the release's total weight is in the finger extension. In one embodiment, the finger extensions consist essentially of a metal, such as stainless steel or aluminum. In one exemplary embodiment a three-finger extension that consists essentially of stainless steel has at least about 55% of the release's total weight in the finger extension. Likewise, a three-finger extension that consists essentially of aluminum has at least about 18% of the release's total weight in the finger extension. In the exemplary embodiment of FIG. 2, a four-finger extension that consists essentially of stainless steel has at least about 90% of the release's total weight in the finger extension. Likewise, a four-finger extension that consists essentially of aluminum has at least about 55% of the release's total weight in the finger extension. Alternative metals include brass. Without wishing to be bound to any particular theory, the weighting may alter the inertia of the release to provide better feedback to the user. The high mass in the finger extension provides the archer with a level of control over the release that is better than the control from releases with low mass triggers. The archer can feel the subtle movements of the release more easily than is possible with low mass triggers. This permits better control.

Figures 3A, 3B, 3C:
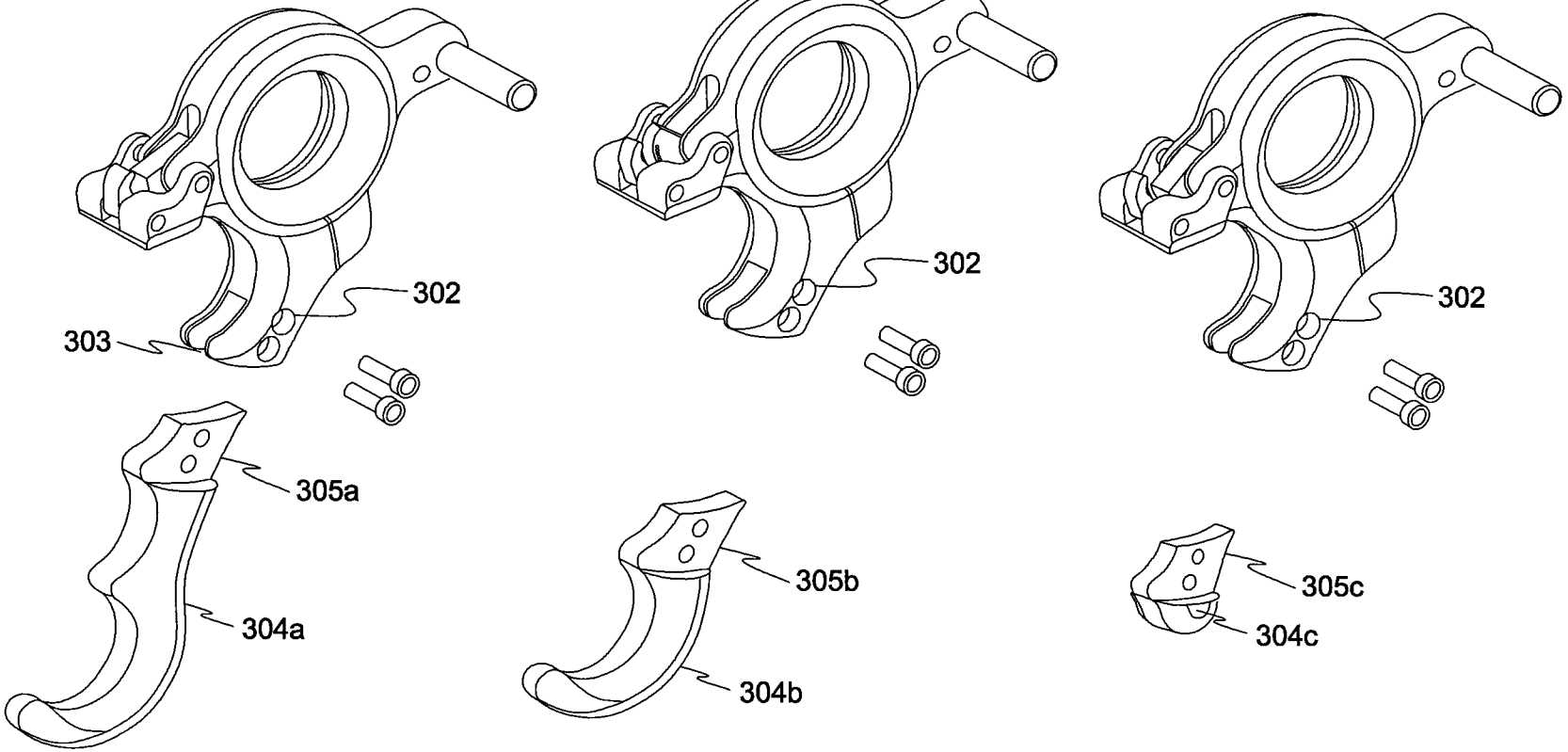
FIG. 3A, FIG. 3B and FIG. 3C are perspective views of three exemplary releases with a four-finger extension, a three-finger extension and a two-finger extension, respectively.

FIG. 3A, FIG. 3B and FIG. 3C depict a release body 302 that comprises a recess 303 that receives a protrusion 305*a*, 305*b*, or 305*c* of a respective finger extension 304*a*, 304*b* or 304*c*. The protrusions 305*a*, 305*b*, or 305*c* are substantially identical such that each mates with the recess 303 to render the finger extensions interchangeable. Finger extension 304*a* is a four-finger extension. Finger extension 304*b* is a three-finger extension. Finger extension 304*c* is a two-finger extension.

Figure 4B:
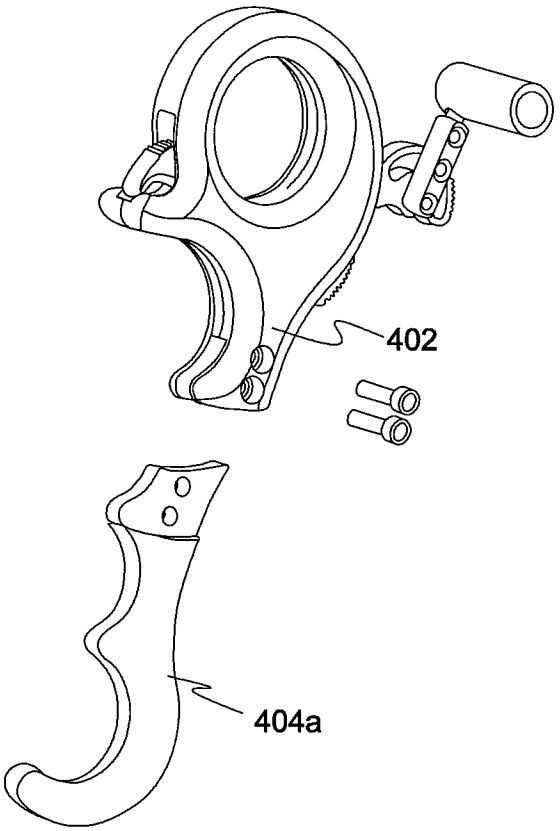
FIG. 4A and FIG. 4B are perspective views of two exemplary releases with a three-finger extension and a four-finger extension, respectively.
Figure 4A:
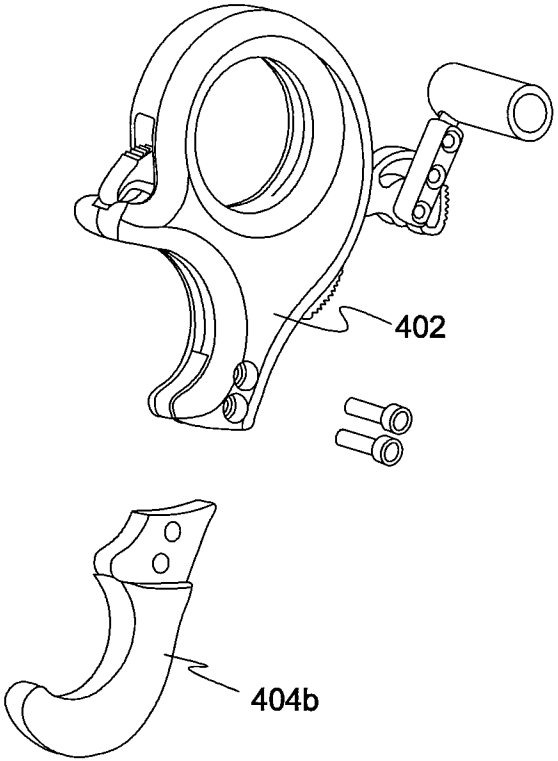
Figure 5A:
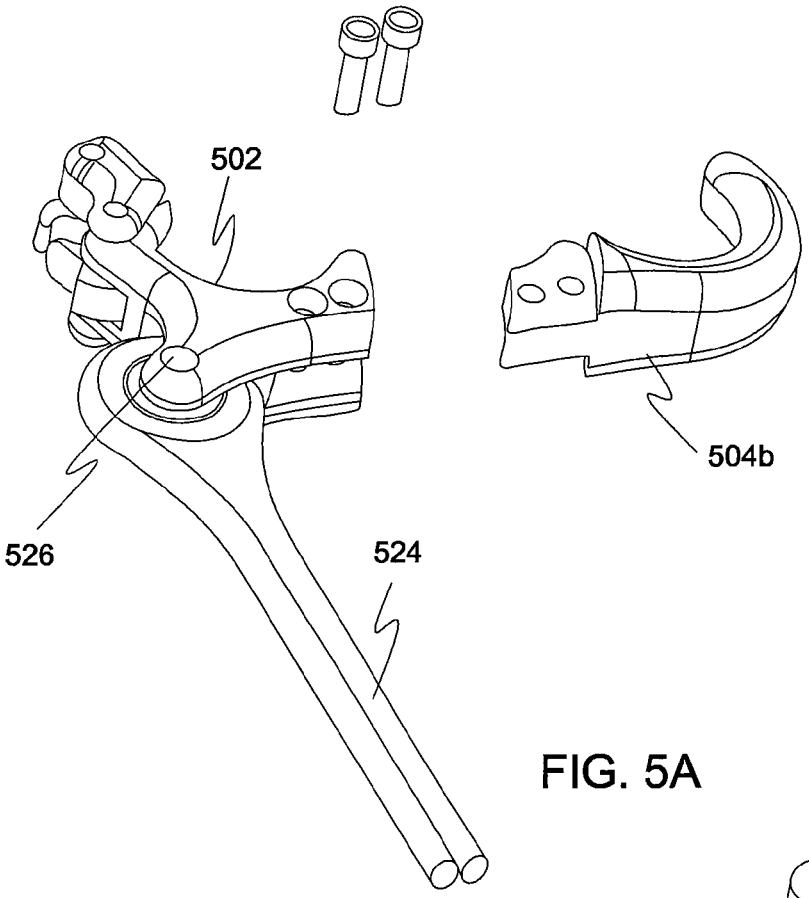
FIG. 5A and FIG. 5B are perspective views of two exemplary releases that use a strap, wherein the views include a two-finger extension and a three-finger extension, respectively.
Figure 5B:
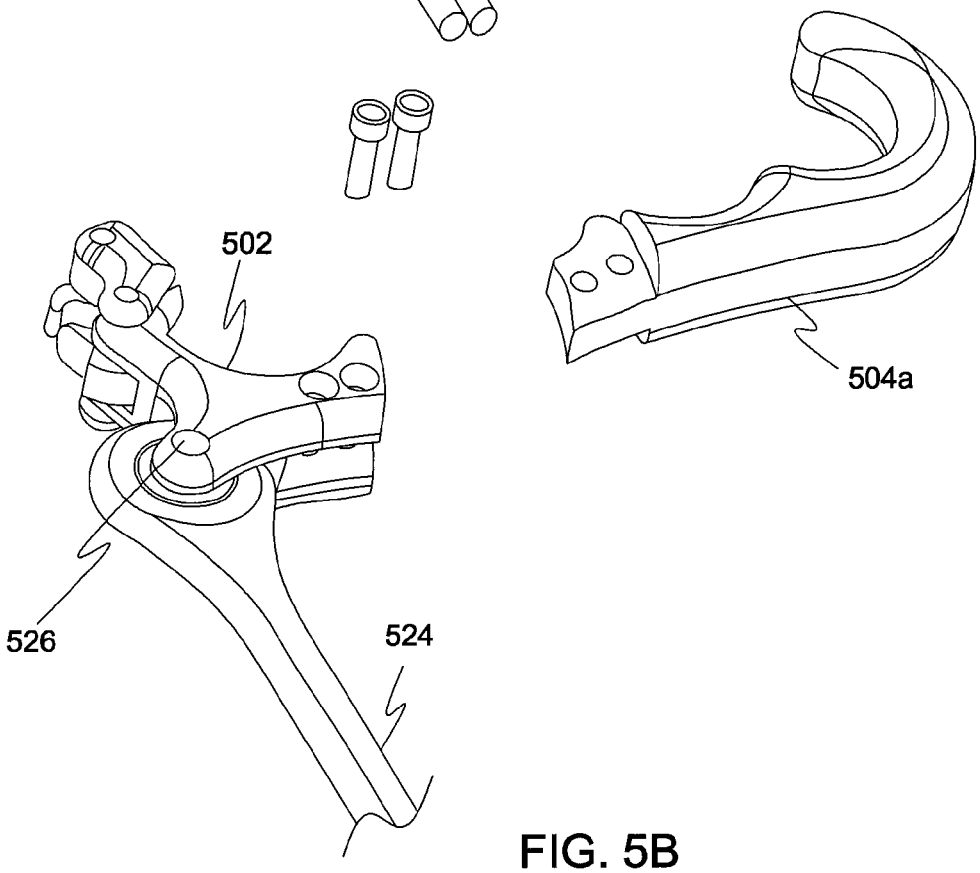

FIG. 4A and FIG. 4B depict alternative embodiments where various finger extensions 404*a*, 404*b* are attached to a common release body 402. As shown in FIG. 5A and FIG. 5B, the finger extensions may also be used on a strap-style back tension release as well. In FIG. 5A, a release body 502 is attached to a two-finger extension 504*b*. A strap 524 connects to the release body 502 at a pivot point 526. The strap 524 may be disposed about the archer's wrist or otherwise configured to help the archer draw the bowstring. FIG. 5B shows a three-finger extension 504*a* connected to the release body 502. In one embodiment, a kit is provided that includes a release body and at least two-finger extensions selected from a two-finger extension, a three-finger extension and a four-finger extension. The archer may selectively use a finger release according to the archer's preference.

Figure 6:
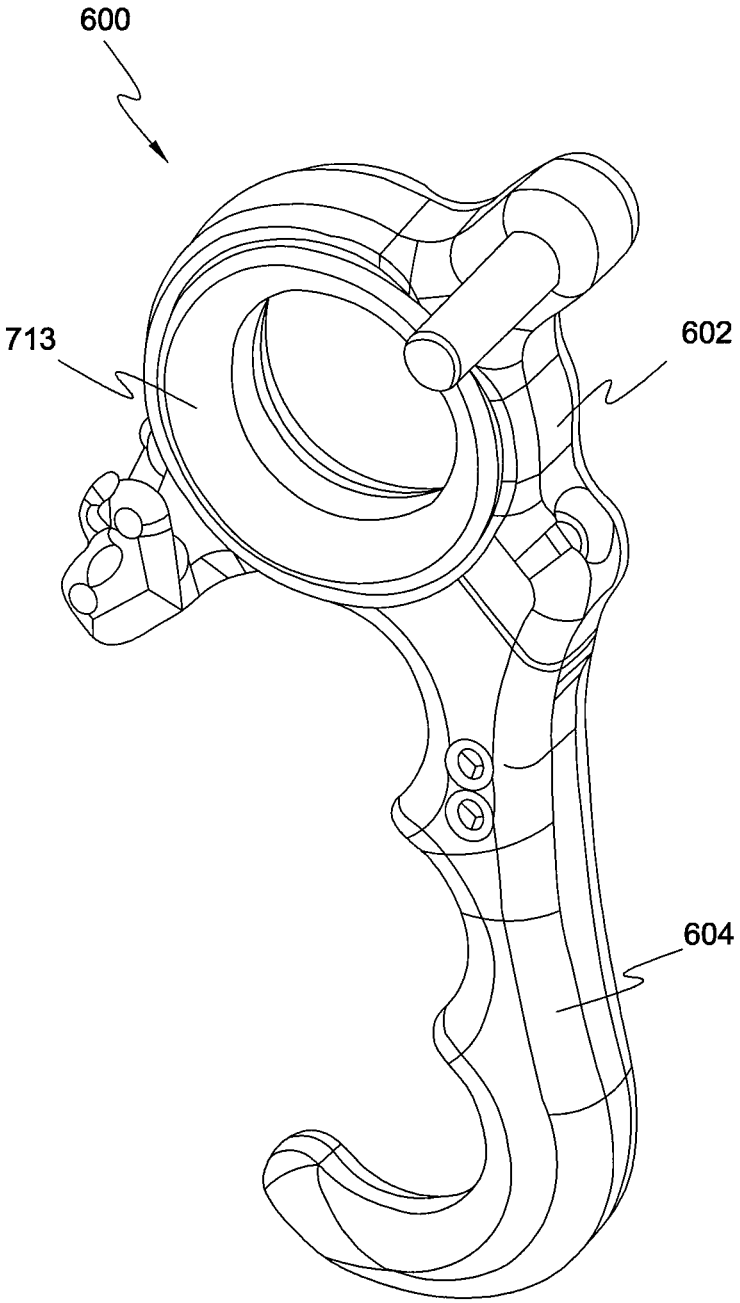
FIG. 6 is a perspective view of an exemplary release comprising a four-finger extension.
Figure 7:
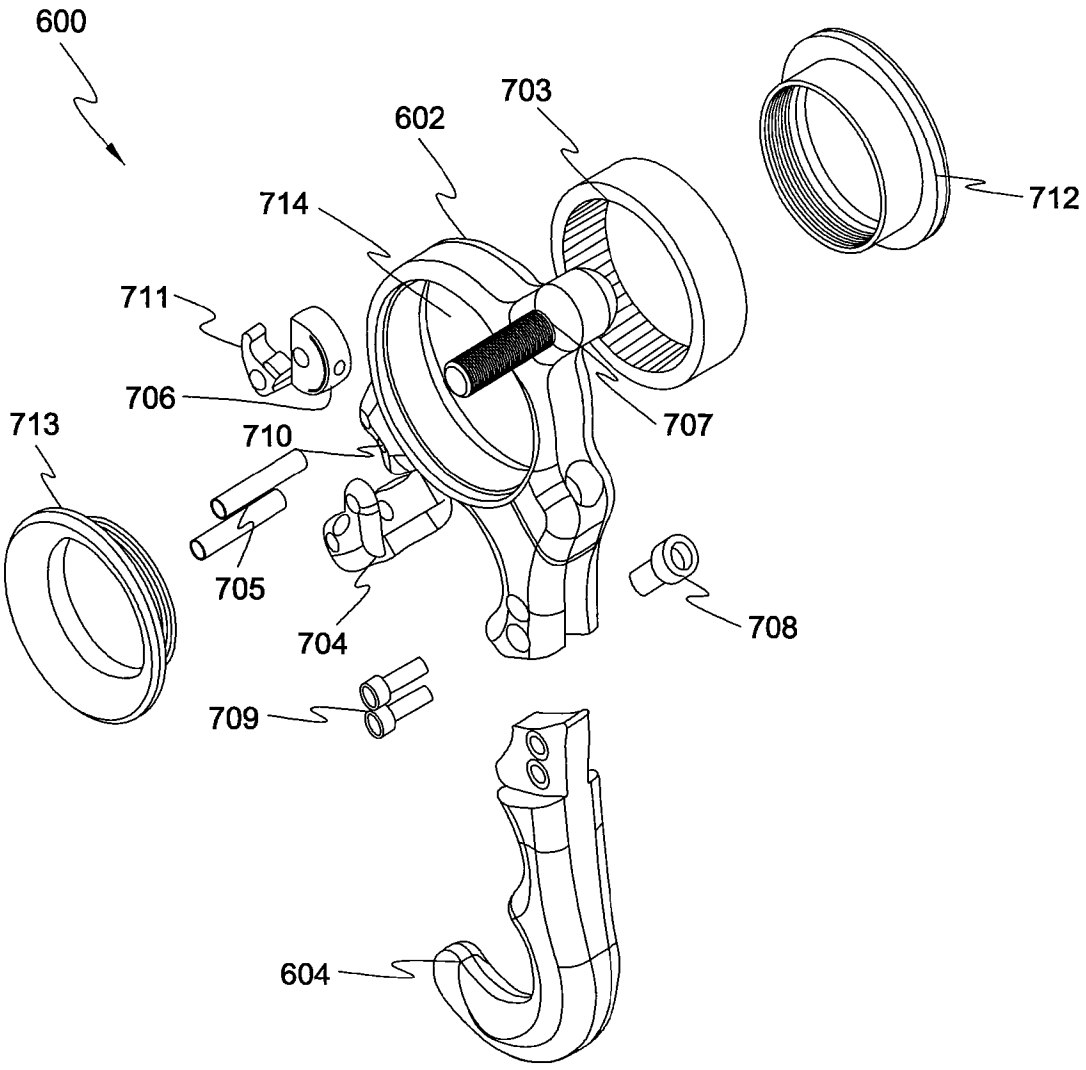
FIG. 7 is an exploded view of an exemplary release comprising a four-finger extension.
Figure 8:
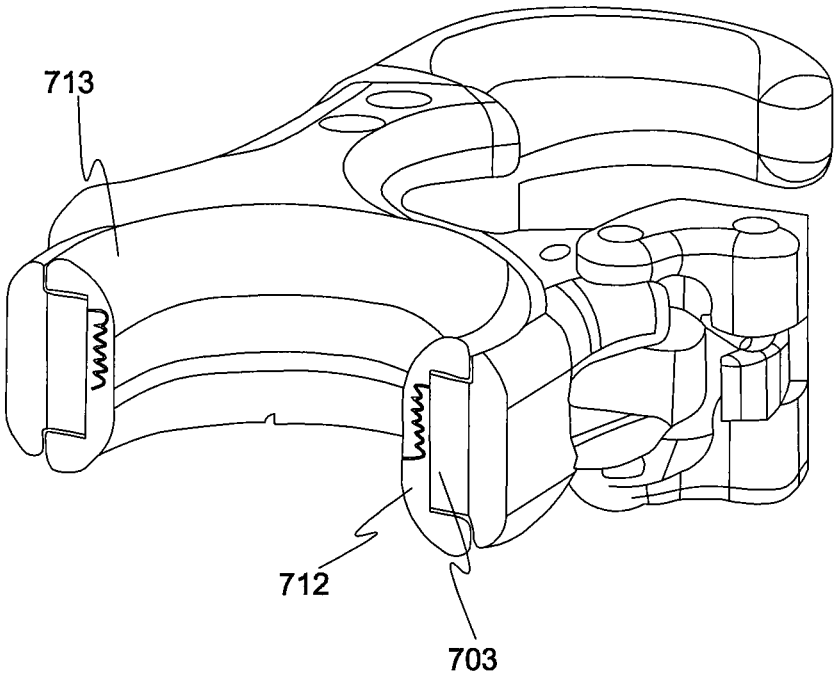
FIG. 8 is a cross section view of a release body of an exemplary release.

FIG. 6 depicts a release 600 with a release body 602 having a bearing ring 713. The release body 602 is releasably connected to a finger extension 604. FIG. 7 is an exploded view of the release 600 of FIG. 6. In another embodiment, not shown, a monolithic release is provided where a release body is monolithic with regard to a finger extension. In the embodiment of FIG. 7, the release body 602 comprises a circular hole 714 housing a ring-shaped bearing 703 disposed therein. A pair of bearing rings 712/713 are disposed about the ring-shaped bearing 703. Each of the bearing rings 712/713 has a lip with a radius that is larger than the radius of the ring-shaped bearing 703. Each of the bearing rings 712/713 also has a threaded ridge on a respective inner and outer wall of a collar. The threaded ridges are mated engage each other to secure the bearing rings 712/713 to one another while rotatably securing the bearing rings 712/713 about the ring-shaped bearing 703. A cross-section view of this engagement is shown schematically in FIG. 8. The bearing rings 712/713 slide against the wall of the ring-shaped bearing 703 such that the bearing rings 712/713 rotate freely and continuously over a full three hundred and sixty degrees without encountering a stop. In use, an archer places a finger through the hole 714 and rests the finger against the bearing rings 712/713. As the bowstring is drawn, a torque develops. The bearing rings 712/713 freely rotate over the ring-shaped bearing 703 to minimize the torque. This results in a more consistent and controlled draw. Many archers find it very difficult to consistently place their hand on a release in the same location for each consecutive shot. For example, on a first shot the archer may be high in the release and on a second shot the archer is mid-low in the release. The results of these two shots will be different. The release 600 provides a plumb bob effect to counteract this tendency. The archer can place a finger anywhere inside the bearing rings 712/713 but once the force of the bow is added the bearing rings 712/713 finds its natural center providing a more consistent angle each single shot. The release 600 allows for a more precise and uniform finger placement due to the bearing rings reaching the same position when force is applied by the archer during the draw cycle. The release reduces inconsistent placement of the finger, providing the archer consistent release alignment regardless of initial placement.

FIG. 7 also depicts a hook assembly comprising bearing bracket 704, a bearing moon 706 and a bearing hook 711, connected about two pivot points provided by bracket pins 705. For examples of the operation of similar hook systems, see U.S. Patent Publication number 2013/0025578. Bolts 709 securely mount the finger extension 604 to the release body 602. A thumb barrel 707 is attached to the release body 602 to permit the archer to use his or her thumb when operating the release 600. A threaded screw 708 permits the selective adjustment of the release as described elsewhere in this specification.

Figure 9C:
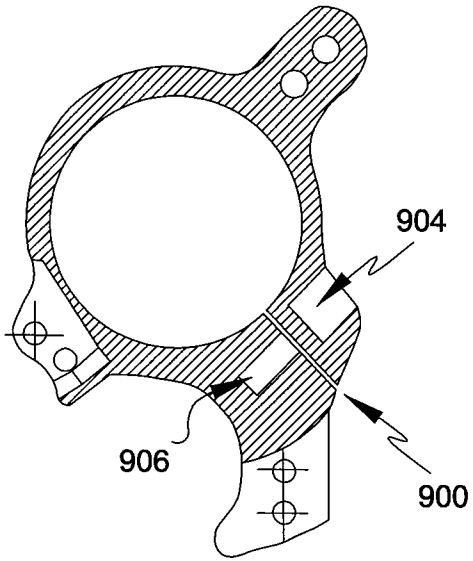
FIG. 9C is a cross section of the release body of FIG. 9A taken along line A-A.
Figure 9B:
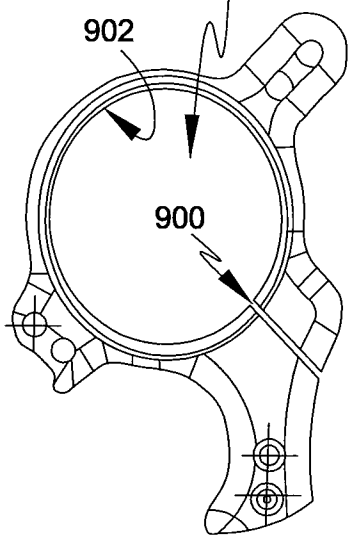
FIG. 9B is a side view of the release body of FIG. 9A.
Figure 9A:
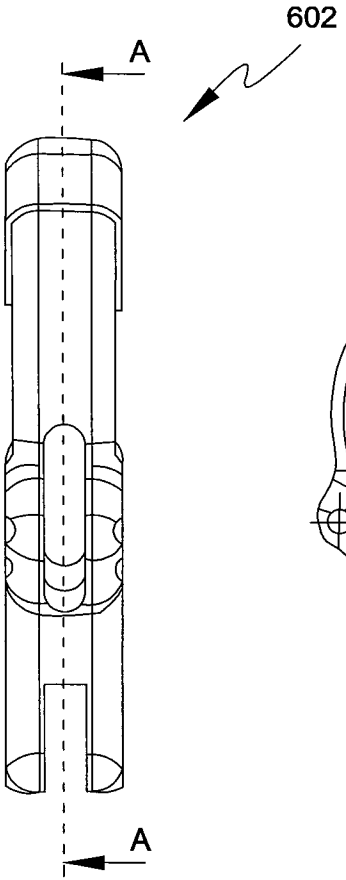
FIG. 9A is an end view of a release body.
Figure 10:
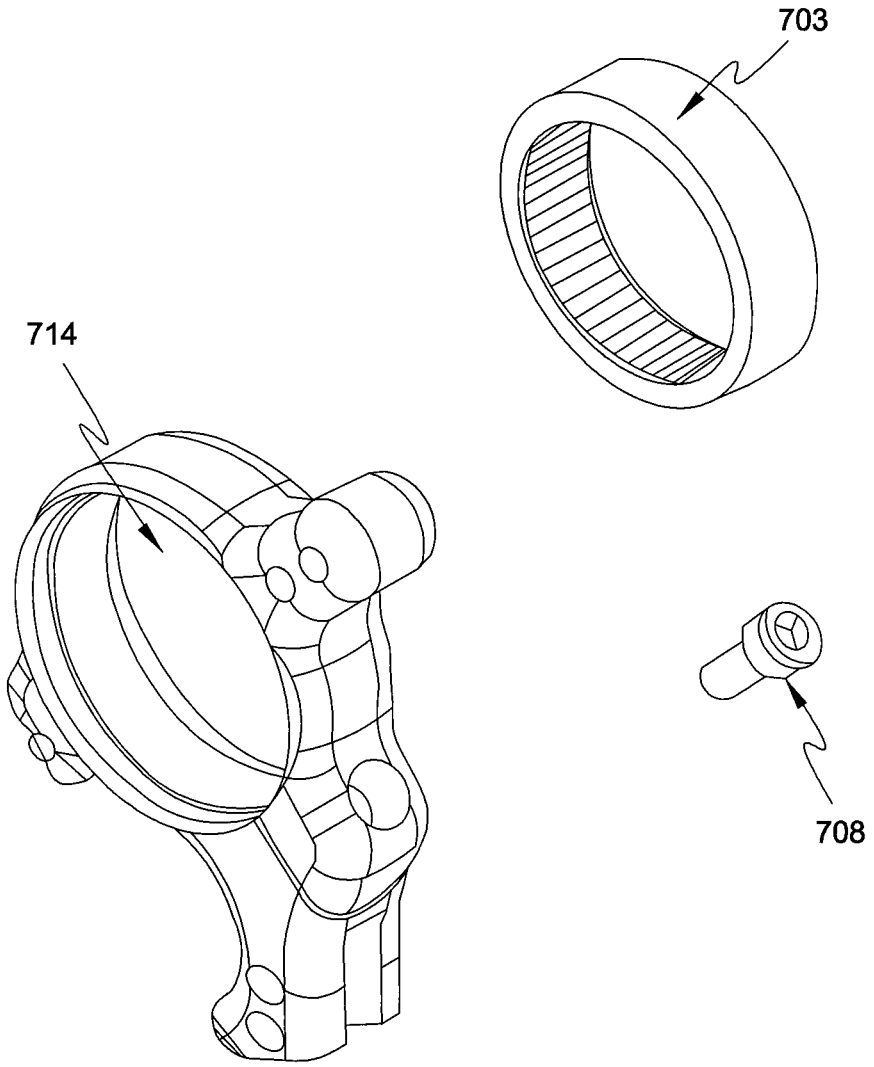
FIG. 10 is a perspective view of a release body showing a screw and a ring shaped bearing.

FIG. 9A is an end view of the release body 602 while FIG. 9B is a side view of the release body 602. FIG. 9C is a cross section view of the release body 602 taken along line A-A of FIG. 9A. The hole 714 has a continuous wall 902 except in that the wall 902 is interrupted by a gap 900. A first opening 904 is present on one side of the gap 900 and a second opening 906 is present on the opposite side of the gap 900, wherein at least one of the openings is threaded. As shown in FIG. 10, a fastener, such as the threaded screw 708, may be placed in openings 904/906 such that the threaded screw 708 bridges the gap 900. In the embodiment depicted, the second opening 906 is threaded such that actuation of the threaded screw 908 selectively adjusts a width of the gap 900. In use, the ring-shaped bearing 703 is placed within the hole and the screw 708 is actuated until the ring-shaped bearing 703 is securely engaged within the hole 714 such that the rotating bearing 703 does not rotate but permits rotation of the bearing rings 712/713. The bearing rings 712/713 are affixed about the ring-shaped bearing 703 such that the bearing rings 712/713 freely rotate. Advantageously, the adjustability provided by threaded screw 708 permits the pieces to be fabricated without needing to resort to precision manufacturing techniques, as variations in each unit can be accommodated by adjusting the threaded screw 708. Additionally, one can control how freely and smoothly the bearing rings 712/713 rotate by changing the tension on the gap 900. For example, a manufacturer may adjust the tension to an acceptable value prior to the product being shipped to a consumer.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A triggerless archery release comprising:

a release body having an inner surface defining an index finger opening configured to receive an index finger, the inner surface including a finger contact surface configured to be pulled in a horizontal direction by an index finger, the finger contact surface extending from a top point to a bottom point, wherein a horizontal axis extends through the bottom point;

a finger extension connected to the release body, the finger extension extending in a vertical direction when the release is oriented in a vertical position; and a triggerless hook assembly connected to the release body, the triggerless hook assembly having a hook, the hook having bowstring engagement portion, the bowstring engagement portion having a hook position located below the horizontal axis when the release is in the vertical position, the triggerless hook assembly configured to release a bowstring upon movement of the hook relative to the bowstring;

wherein the release has a total weight, and the release has a weight distribution wherein at least 50% of the total weight is in the finger extension, and wherein the hook position and the weight distribution contribute, at least partially, to an enhanced control over the release of the bowstring.

2. The triggerless archery release as recited in claim 1, wherein the finger extension is removably connected to the release body with at least one fastener.

3. The triggerless archery release as recited in claim 1, wherein the finger extension is integral with the release body.

4. The triggerless archery release as recited in claim 1, wherein at least 90% of the total weight is in the finger extension.

5. The triggerless archery release as recited in claim 1, wherein the index finger opening has an inner perimeter, the inner perimeter having a top perimeter point and a bottom perimeter point, wherein a bottom horizontal axis extends through the bottom horizontal point, the hook position being located below the bottom horizontal axis when the release is in the vertical position.

6. The triggerless archery release as recited in claim 5, wherein the finger extension is integral with the release body.

7. The triggerless archery release as recited in claim 1, wherein:

the finger extension comprises at least a first finger contact surface and a second finger contact surface; and the first finger contact surface and the second finger contact surface are separated by a crest.

8. The triggerless archery release as recited in claim 1, wherein:

the release body has an inner perimeter defining an index finger opening configured to receive the index finger, the inner perimeter having a perimeter top point and a perimeter bottom point, wherein the perimeter bottom point lies in a horizontal plane when the release is in the vertical position; and the hook position is located below the horizontal plane when the release is in the vertical position.

9. The triggerless archery release as recited in claim 1, wherein the finger extension comprises at least a first finger contact surface, a second finger contact surface and a third finger contact surface.

10. The triggerless archery release as recited in claim 9, wherein the first finger contact surface and the second finger contact surface are separated by a first crest and the second finger contact surface and the third finger contact surface are separated by a second crest.

11. An archery release comprising:

a release body having an inner perimeter defining an index finger opening configured to receive an index finger, the inner perimeter having a perimeter top point and a perimeter bottom point wherein the perimeter bottom point lies in a horizontal plane;

a finger extension connected to the release body; and a hook connected to the release body, the hook having a bowstring engagement portion, the bowstring engagement portion being located below the horizontal plane when the archery release is oriented in a vertical position;

wherein the archery release has a total weight, and the archery release has a weight distribution wherein at least 50% of the total weight is in the finger extensional, and wherein the weight distribution and the position of the bowstring engagement portion contribute, at least partially, to an enhanced control over the release of the bowstring.

12. The archery release as recited in claim 11, wherein the finger extension is removably connected to the release body with at least one fastener.

13. The archery release as recited in claim 11, wherein the finger extension extends in a vertical direction when the archery release is in the vertical position.

14. The archery release as recited in claim 11, wherein at least 90% of the total weight is in the finger extension.

15. The archery release as recited in claim 11, which includes a triggerless hook assembly, wherein the hook is a part of the triggerless hook assembly.

16. The archery release as recited in claim 11, wherein the finger extension is integral with the release body.

17. A kit comprising:

a plurality of finger extensions including:

(a) a three-finger extension configured to be removably connected to a release body; and (b) a four-finger extension configured to be removably connected to the release body; and an archery release comprising:

the release body with a recess, wherein the recess is configured to connect to a finger extension selected from the group consisting of the three-finger extension and the four-finger extension having an inner perimeter defining an index finger opening configured to receive an index finger, the inner perimeter having a perimeter top point and a perimeter bottom point, wherein the perimeter bottom point lies in a horizontal plane; and a hook connected to the release body, the hook configured to release a bowstring upon movement of the hook relative to the bowstring, the hook including a bowstring contact surface having a position, the position of the bowstring contact surface being located below the horizontal plane when the archery release is oriented in a vertical position;

wherein the archery release has a total weight;

wherein when a single one of the finger extensions is connected to the release body, at least 50% of the total weight is distributed in the single finger extensional; and wherein the distribution of the total weight and the position of the bowstring contact surface contribute, at least partially, to an enhanced control over the release of the bowstring.

18. The kit as recited in claim 17, which includes a fastener configured to connect one of the finger extensions to the release body.

19. The kit as recited in claim 17, wherein each one of the finger extensions is configured to extend in a vertical direction when the release body is in the vertical position.

20. The kit as recited in claim 17, wherein the release body defines a recess, each one of the finger extensions having a coupling portion configured to be inserted into the recess.

* * * * *